US005823496A

United States Patent [19]

Foley et al.

[11] Patent Number: 5,823,496

[45] Date of Patent: Oct. 20, 1998

[54] OUTDOOR BEVERAGE HOLDER ASSEMBLY

[76] Inventors: Anthony Foley; Sandra Foley, both of 316 A Texas Rd, Old Bridge, N.J. 08857

[21] Appl. No.: 492,210

[22] Filed: Jun. 19, 1995

[51] Int. Cl.[6] ..... A47F 5/00; A47F 7/00

[52] U.S. Cl. ..... 248/314; 248/231.9; 248/311.2; 248/291.1; 248/156

[58] Field of Search ..... 248/311.2, 314, 248/291.1, 231.9, 156

[56] References Cited

U.S. PATENT DOCUMENTS

| | | | |
|---|---|---|---|
| 2,692,106 | 10/1954 | Herrmann | 248/314 X |
| 2,749,067 | 6/1956 | Gorenflo | 248/314 X |
| 3,010,687 | 11/1961 | Hogberg | 248/314 X |
| 3,586,274 | 6/1971 | Hart | 248/314 X |
| 3,612,454 | 10/1971 | Linn | 248/314 X |
| 3,881,269 | 5/1975 | Timmons | 248/314 X |
| 4,093,171 | 6/1978 | Mengo, Sr. | 248/314 X |
| 4,716,674 | 1/1988 | Kammeroad | 248/231.9 X |
| 5,007,612 | 4/1991 | Montre | 248/314 X |
| 5,356,107 | 10/1994 | Sinohuiz | 248/311.2 |
| 5,484,129 | 1/1996 | Megal | 248/311.2 |

*Primary Examiner*—Creighton Smith
*Assistant Examiner*—W. Glenn Edwards
*Attorney, Agent, or Firm*—Brian K. Dinicola

[57] ABSTRACT

A beverage holder which comprises an elongated member having a pointed, ground penetrating tip, a container carrier dimensioned to receive a beverage container such as an aluminum can containing soda, beer, or the like, and a pivotal coupling assembly for coupling the container carrier to the elongated member, the carrier being selectively angularly positionable into an upright orientation relative to the elongated member regardless of the angular position of the latter relative to the ground. Illustratively, the elongated member may be configured with an axial bore dimensioned and arranged to receive and support the butt-end or handle portion of a fishing pole, the thus configured beverage holding assembly functioning also as a fishing pole holder.

18 Claims, 2 Drawing Sheets

OUTDOOR BEVERAGE HOLDER ASSEMBLY

BACKGROUND OF THE INVENTION

1. Field of the Invention

The present invention relates generally to holders for beverage containers and, more particularly, to beverage container holders which are portable and which can provide insulated protection for a beverage and which are releasably attachable to a fishing pole holder or the like.

2. Description of the Background Art

During such outdoor activities as barbecues, picnics, and sporting events, the possessor of a cylindrical, or partially cylindrical (e.g. a beverage container) article wishes to set it down so as to leave his or her hands free for other purposes such as for holding and eating a plate of food or, while fishing at the shoreline of a body of water, to pick up a fishing pole from a pole holder when a fish is on the line.

A number of holders have, of course, been made available for supporting a beverage container when a person drinking from the container puts the container down to perform another activity. In an application where the holder is secured to a moving object such as an automobile, a boat. a golf cart or the like, the holder typically includes a container carrier that adjusts to the movement of the vehicle so that the beverage container is maintained in a generally upright orientation and liquid is not spilled from the container as the vehicle encounters bumps or turns, is lifted, bounced or otherwise jostled. Holders providing a container carrier which maintain the beverage in a level position often include a carrier adapted to hold a beverage container pivotally connected to a mounting which, in turn, is secured to a support on the vehicle. This type of carrier is susceptible to sudden, jarring movements and does not allow the user to select a fixed orientation of the carrier relative to the supporting structure.

The past time of fishing is often accompanied by a desire for refreshment, and as a consequence many fishermen drink from cans or cups of liquids such as beer or soft drinks. In many instances there is no convenient place to hold such beverage containers in and around the fishing site. U.S. Pat. No. 4,645,167 describes a boat seat arrangement having a complicated accessory assembly. The latter includes an upright tray presenting a central beverage container holder, together with a pivotal arm supporting a fishing rod holder. While devices of this character may be suitable for large boats, they do not address the needs of the angler standing on the shore of a river, lake, or ocean.

U.S. Pat. No. 3,917,134 describes an equipment carrier designed to be worn about the waste of a fisherman. This belt-like device includes a rod holder and an accessory beverage container holder. However, devices of this character are inherently unstable and significantly inhibit the movement of the fisherman.

SUMMARY OF THE INVENTION

According to the present invention, the abovementioned deficiencies of the prior art are avoided by a beverage holder assembly which comprises an elongated member having a pointed, ground penetrating tip, a container carrier dimensioned to receive a beverage container such as an aluminum can containing soda, beer, or the like, and pivotable coupling means for coupling the container carrier to the elongated member, the carrier being selectively angularly positionable into an upright orientation relative to the elongated member regardless of the angular position of the latter relative to the ground.

In accordance with an illustrative embodiment of the present invention, the elongated member defines an axial bore dimensioned and arranged to receive and support the butt-end or handle portion of a fishing pole, the beverage holding assembly functioning also as a fishing pole holder. The holder assembly of the present invention may be configured with a plurality of container carriers, and may be utilized on the beach, river bank, or in picnic or backyard barbecue areas.

The various features of novelty which characterize the invention are pointed out with particularity in the claims annexed to and forming a part of the disclosure. For a better understanding of the invention, its operating advantages, and specific objects attained by its use, reference should be had to the accompanying drawings and descriptive matter in which there are illustrated and described several embodiments of the invention.

BRIEF DESCRIPTION OF THE DRAWINGS

The features and advantages of the present invention will be more readily understood from the following detailed description when read in conjunction with the accompanying drawings, in which.

DETAILED DESCRIPTION OF THE INVENTION

In the description which follows, like parts are marked throughout the specification and drawings, respectively. The drawings are not necessarily to scale and in some instances, proportions have been exaggerated in order to more clearly depict certain features of the invention.

Figure 1:
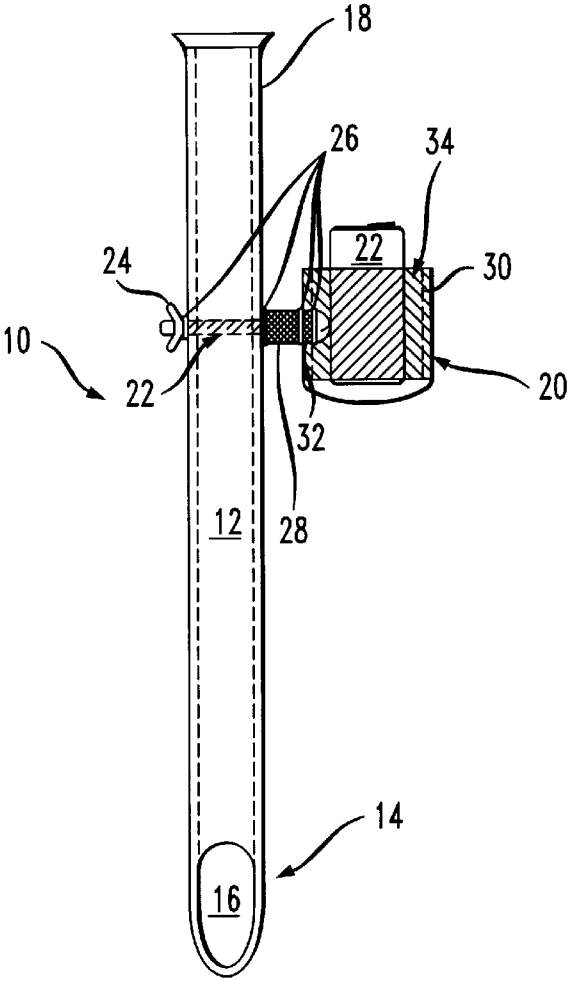
FIG. 1 is a front elevation view depicting a beverage holder constructed in accordance with the present invention.

An outdoor beverage holder 10 constructed in accordance with an illustrative embodiment of the present invention is shown in FIG. 1. As seen in FIG. 1, holder 10 includes an elongated member 12 having a pointed tip 14 for implantation in sand, as would be found along the shoreline of a body of water or in soil, as would be found in a picnic area, back yard, or the like. Although elongated member 12 may be comprised of any suitable rigid material, it is preferably constructed of a lightweight plastic material such, for example, as polyvinyl chloride (PVC) so as to facilitate portability and ease of use. Advantageously, tip 14 may be formed by cutting the lower portion of a tubular elongated member at an appropriate angle to thereby obtain a hollow tip configuration. Alternatively, however, the tip 14 may be configured as a solid point tightly fitted onto the lower end of elongated member 12 and held in place by a roll pin or other suitable fastener.

In the illustrative embodiment of FIG. 1, elongated member 10 is substantially tubular, defining a longitudinal bore 16 that extends from pointed tip 14 to upper end 18. It will be readily appreciated by those skilled in the art, of course, that this need not necessarily be the case. In the case of a fishing pole holder constructed in accordance with the present invention, for example, bore 16 need only extend from upper end 18 to an intermediate point along elongated member 12 to define a bore of sufficient length and diameter to insertably retain the butt-end or handle portion of a fishing pole. If desired, the upper end 18 may be flared to facilitate the insertion of a fishing rod. In the case where bore 16 extends continuously through elongated member 12, the depth of insertion of the fishing rod may be limited by one or more rod support members (not shown) transversely oriented across the bore at a location suitable to provide support for the butt-end of a fishing rod while allowing water to drain through.

The length of elongated member 12 is selected for maximum convenience to the user. The entire beverage holder assembly is highly compact and should easily fit into the trunk or hatch of an automobile for maximum portability. A length of between 23" and 36" has been found to be acceptable for most applications.

With continued reference to the embodiment of FIG. 1, it will be observed that a cylindrically shaped receptacle 20, having an interior chamber dimensioned to retain a beverage container such as aluminum can 22, is pivotably coupled to elongated member 12 so as to enable receptacle 20 to be retained in any desired angular orientation relative to the elongated member 12. Any suitable coupling assembly may be employed to pivotably couple receptacle 20 to elongated member 12. Illustratively, receptacle 20 may be coupled to the elongated member 12 by a threaded fastener assembly comprising a bolt 22, wing nut 24, stainless steel washers 26, and a bushing 28 comprised of an elastomeric material such as natural or artificial rubber, or the like. The sidewall 30 of receptacle 20 defines an aperture 32 dimensioned and arranged to receive at least a portion of bushing 28 so that when bolt 22 is inserted therethrough and wing nut 24 is tightened, receptacle 20 may be locked into the angular position that orients beverage container 22 in a substantially vertical manner.

As will be readily appreciated by those skilled in the art, the resilient characteristics of bushing 28 will permit the user to manually adjust the angular position of receptacle 20 without loosening and re-tightening of wing nut 24. It is significant, however, that the receptacle 20 is not subject to tipping during sudden, jarring movements of elongated member 12.

In accordance with an especially preferred embodiment of the present invention, the cavity of receptacle 20 is dimensioned and arranged to receive a barrier 34 of a material having suitable heat insulating properties such, for example, as a commercially available neoprene foam material or the like.

Figure 2:
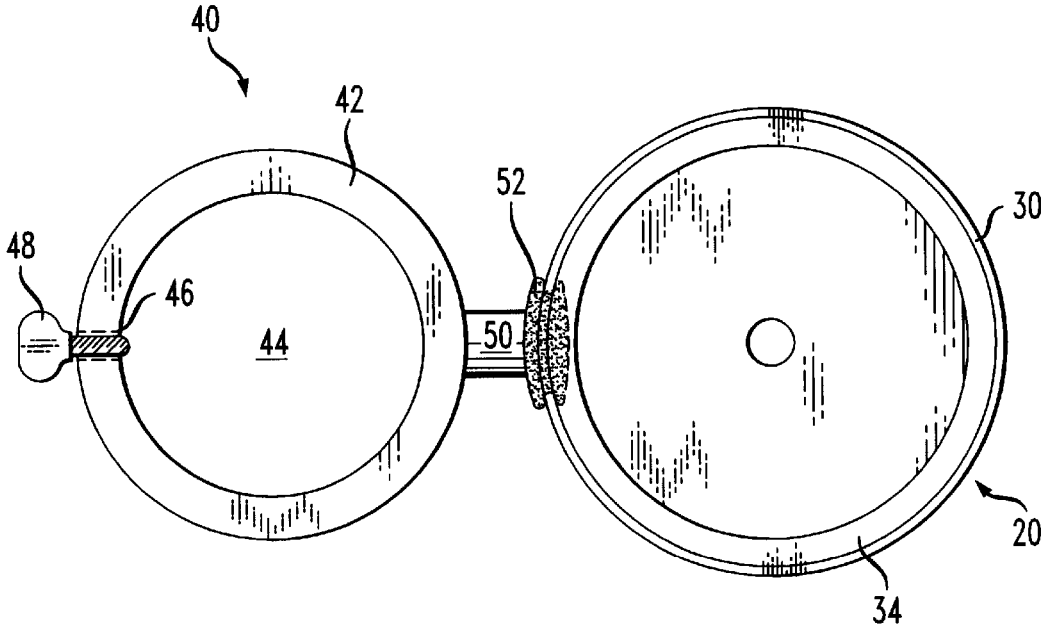
FIG. 2 is a plan view depicting a coupling assembly constructed in accordance with a modified embodiment of the present invention.

With reference now to FIG. 2, there is shown an alternate arrangement for pivotably coupling receptacle 20 to elongated member 12 in accordance with the teachings of the present invention. As seen in FIG. 2, coupling assembly 40 comprises a tubular sleeve 42 having an interior bore 44 dimensioned and arranged to receive elongated member 12 for sliding movement therealong. The side wall of sleeve 42 defines an aperture 46 dimensioned to receive a threaded member such, for example, as thumb screw 48. As will be readily appreciated by those skilled in the art, as thumb screw 48 is tightened within aperture 46, the tip of the former engages the outer surface of elongated member 12, thereby locking receptacle 20 at a desired position therealong.

Figure 3:
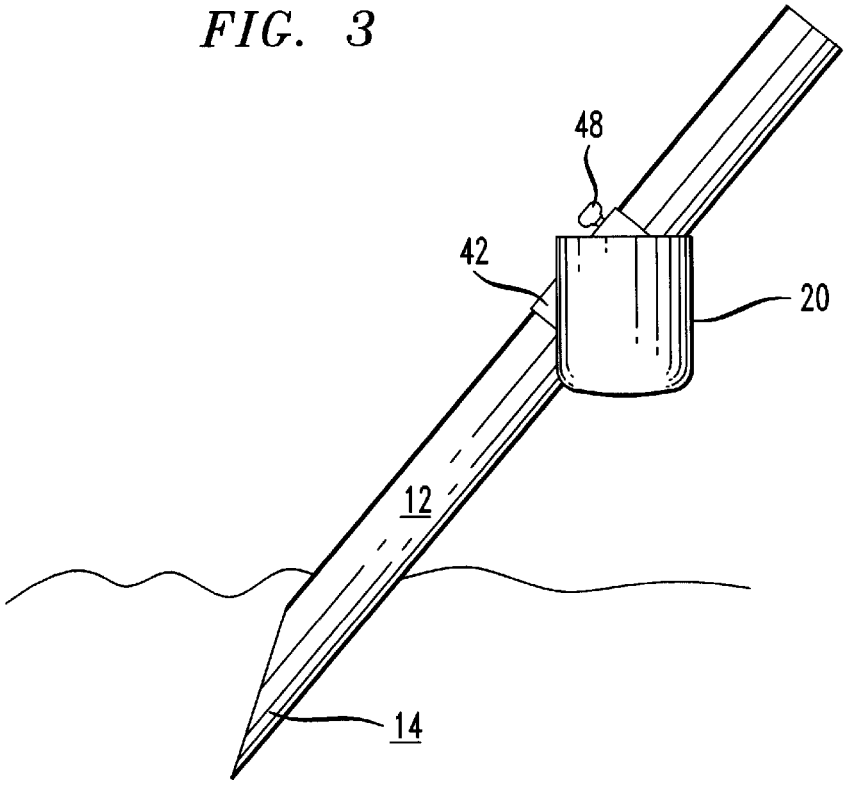
FIG. 3 is a side elevation view showing the selective angular positioning of the container carrier or receptacle in accordance with the present invention.

In the embodiment of FIG. 2, sleeve 42 further includes a projecting member 50 which extends from the outer surface of the sleeve sidewall. A grommet 52 which is comprised of an elastomeric material such, for example, as natural or artificial rubber or the like, extends into the aperture 32 of receptacle 20 to form a resiliently pivotable connection that allows the receptacle to be manipulated into any desired angular orientation but which does not allow the receptacle to rotate freely. In this manner, a beverage container received within receptacle 20 can be positioned in a substantially upright manner regardless of the angular position of elongated member 12, as illustratively depicted in FIG. 3.

Figure 4:
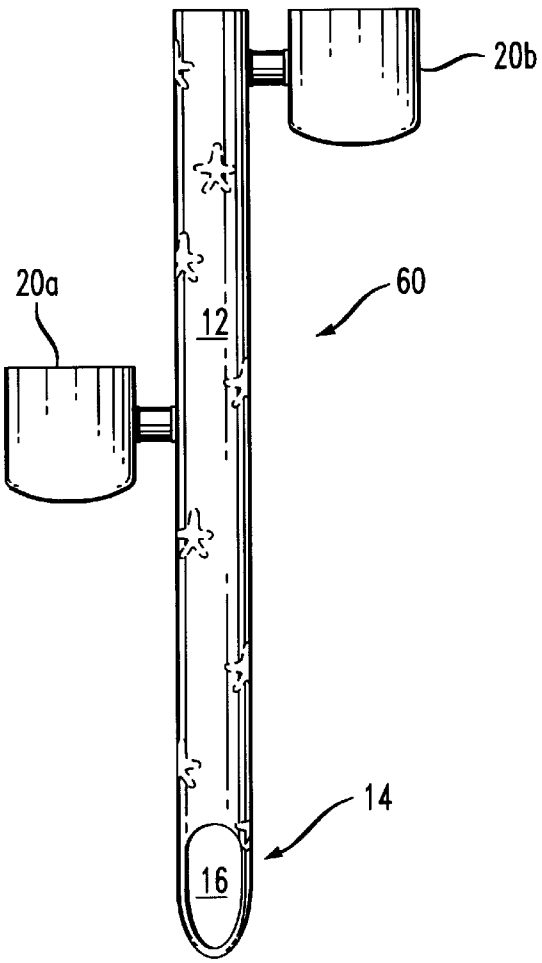
FIG. 4 is a front elevation view depicting a beverage holder assembly constructed in accordance with the present invention and adapted to support two beverage containers.

The teachings of the present invention are broadly applicable to a wide variety of outdoor environments in which no planar surface is available upon which to support one or more beverage containers . Illustratively, there is shown in FIG. 4 an example of a beverage holder assembly 60 which may be utilized by beachgoers to support plural beverage containers (not shown). As seen in FIG. 4, first and second receptacles 20*a* and 20*b* may be coupled to elongated member 12 at different heights. Preferably, the lowermost receptacle 20*a* is located at least 12–15 inches from the tip of elongated member 12 to ensure adequate accessibility to a user seated adjacent to holder assembly 10 when the tip 14 is implanted in beach sand. If implantation of assembly 10 is contemplated in a location where the ground is more compact, such as a picnic area or backyard, the overall length of elongated member 12 may be substantially reduced and the lowermost receptacle positioned substantially closer to the tip, since less ground penetration is needed.

It will, of course, be readily ascertained by those skilled in the art that a wide variety of modifications may be made without departing from the spirit and scope of the present invention. For example, rather than being configured with a single cylindrically shaped sidewall, receptacle 20 may instead be comprised of three or more vertically spaced annular rings, connected by a vertical strip, with the lowest annular ring having two strips to support a beverage container.

From the foregoing, it should be readily ascertained that the invention is not limited by the embodiments described above which are presented as examples only but may be modified in various ways within the intended scope of protection as defined by the appended patent claims.

What is claimed is:

1. A beverage holder assembly, comprising:

an elongated member having a pointed, ground engaging tip at a first end thereof;

a support structure for holding a beverage container, said support structure including an arcuate container-engaging member pivotally interconnected to said elongated member; and coupling means for pivotably interconnecting said support structure to said elongated member, said coupling means being configured to maintain the support structure in a desired angular position relative to the elongated member despite sudden jarring movements thereof but allowing said user to retain a beverage container received therein in a substantially upright orientation relative to an underlying support surface.

2. The beverage holder assembly of claim 1, wherein said elongated member defines a longitudinal bore dimensioned and arranged to receive and support a fishing pole handle.

3. The beverage holder assembly of claim 2, further including a transverse support member, disposed within said longitudinal bore, for supporting the fishing pole handle.

4. The beverage holder assembly of claim 2, wherein a second end of said elongated member is flared to facilitate insertion of the fishing pole handle.

5. The beverage holder assembly of claim 1, wherein said support structure comprises a base, and a cylindrically shaped side wall extending upward from said base, said support structure defining an interior cavity dimensioned and arranged to receive a beverage container.

6. The beverage holder assembly of claim 5, wherein said support structure further includes a heat-insulating sleeve member disposed within said interior cavity.

7. The beverage holder assembly of claim 1, wherein said elongated member and said arcuate container-engaging member define alignable apertures extending therethrough and wherein said coupling means comprises a threaded fastener and a rubber bushing insertable through said apertures.

8. The beverage holder assembly of claim 1, wherein said coupling means includes a sleeve member slidably disposed on said elongated member and having a thumb screw manipulable to lock the sleeve member in a desired location along said elongate member.

9. The beverage holder assembly of claim 8, wherein said coupling means further includes a radial projection extending outwardly from the sleeve member, said projection having an elastomeric grommet insertable in a tight-fitting manner into an aperture defined in the arcuate container engaging member.

10. The beverage holder assembly of claim 9, further including a second support structure for holding a second beverage container, said second support structure being pivotably interconnected to said elongated member and including a second arcuate container-engaging member, said coupling means further including a second radial projection extending outwardly from the sleeve member, wherein said second projection includes a second elastomeric grommet insertable in a tight-fitting manner into an aperture defined in the second arcuate container engaging member.

11. The beverage holder assembly of claim 1, further including a second support structure for holding a second beverage container, said second support structure including a second arcuate container-engaging member pivotally interconnected to said elongated member.

12. A beverage holder assembly, comprising:

an elongated member having an upper end, a lower end, and at least one sidewall surface extending therebetween, said lower end terminating in a pointed, ground engaging tip formed by a second surface contiguous with said at least one sidewall and defining an acute angle therewith;

a support structure for holding a beverage container, said support structure including an arcuate container-engaging member pivotally interconnected to said elongated member; and coupling means for pivotably interconnecting said support structure to said elongated member, said coupling means being configured to maintain the support structure in a desired angular position relative to the elongated member despite sudden jarring movements thereof but allowing said user to retain a beverage container received therein in a substantially upright orientation relative to an underlying support surface.

13. The beverage holder assembly of claim 12, wherein said support structure comprises a base, and a cylindrically shaped side wall extending upward from said base, said support structure defining an interior cavity dimensioned and arranged to receive a beverage container.

14. The beverage holder assembly of claim 13, wherein said support structure further includes a heat insulating sleeve member disposed within said interior cavity.

15. The beverage holder assembly of claim 13, further including a second support structure for holding a second beverage container, said second support member being pivotably interconnected to said elongated member at a different elevation between said upper and lower ends than said first support structure, said second support structure defining a second interior cavity dimensioned and arranged to receive a second beverage container.

16. The beverage holder assembly of claim 12, further including a second support structure for holding a second beverage container, said second support member being pivotably interconnected to said elongated member at a different elevation between said upper and lower ends than said first support structure.

17. The beverage holder assembly of claim 12, further including a second support structure for holding a second beverage container, said second support member being pivotably interconnected to said elongated member and including a second arcuate container-engaging member.

18. The beverage holder assembly of claim 17, wherein the upper end of said elongated member defines a flared longitudinal bore dimensioned and arranged to receive and support a fishing pole handle.

* * * * *